US012195227B2

(12) United States Patent
Parda et al.

(10) Patent No.: US 12,195,227 B2
(45) Date of Patent: Jan. 14, 2025

(54) CONTAINER HAVING GUSSETS

(71) Applicant: Krones Inc., Franklin, WI (US)

(72) Inventors: Chase Nicolette Parda, Whitefish Bay, WI (US); James William Cushman, Milwaukee, WI (US)

(73) Assignee: Krones Inc., Franklin, WI (US)

( * ) Notice: Subject to any disclaimer, the term of this patent is extended or adjusted under 35 U.S.C. 154(b) by 27 days.

(21) Appl. No.: 17/862,035

(22) Filed: Jul. 11, 2022

(65) Prior Publication Data

US 2024/0010384 A1 Jan. 11, 2024

(51) Int. Cl.

| | |
|---|---|
| ***B65D 1/46*** | (2006.01) |
| ***B65D 1/02*** | (2006.01) |
| ***B65D 1/42*** | (2006.01) |
| ***B65D 79/00*** | (2006.01) |

(52) U.S. Cl.

CPC ..... *B65D 1/46* (2013.01); *B65D 1/0284* (2013.01); *B65D 1/42* (2013.01); *B65D 79/0084* (2020.05); *B65D 2501/0036* (2013.01)

(58) Field of Classification Search

CPC ..... B65D 2501/0036; B65D 1/46; B65D 1/0284; B65D 79/0084; B65D 1/42

USPC ..... 215/342

See application file for complete search history.

(56) References Cited

U.S. PATENT DOCUMENTS

| | | | |
|---|---|---|---|
| D65,754 | S | 10/1924 | Mas |
| D68,732 | S | 11/1925 | Root |
| 3,208,631 | A | 9/1965 | Edwards |
| D257,595 | S | 12/1980 | Bullock |
| D294,117 | S | 2/1988 | Rogler et al. |
| 4,804,097 | A | 2/1989 | Alberghini et al. |
| 5,632,397 | A | 5/1997 | Fandeux et al. |
| 5,746,339 | A | 5/1998 | Petre et al. |
| 6,016,932 | A | 1/2000 | Gaydosh et al. |

(Continued)

FOREIGN PATENT DOCUMENTS

| | | |
|---|---|---|
| AU | 201812695 | 11/2018 |
| DE | 10 2019 105 005 A1 | 8/2020 |
| WO | WO-2012/013188 A2 | 2/2012 |

OTHER PUBLICATIONS

Ex Parte Quayle Action issued for U.S. Appl. No. 29/845,843 dated Feb. 1, 2024 (14 pages).

(Continued)

*Primary Examiner* — Robert J Hicks
*Assistant Examiner* — Sanjidul Islam
(74) *Attorney, Agent, or Firm* — Foley & Lardner LLP

(57) ABSTRACT

A container includes a base, a neck portion, and a body positioned between the base and the neck portion. The base includes a plurality of feet with a plurality of recesses positioned between the plurality of feet. The body includes a plurality of ribs, a plurality of channels, and a plurality of support columns. The plurality of ribs extend around a periphery of the body and along at least a portion of a height of the body. The plurality of channels extend around the periphery and are positioned between the plurality of ribs. The plurality of support columns are spaced about the periphery and extend along at least a portion of the height of the body. Each of the plurality of support columns includes a plurality of protrusions that are vertically aligned. Each of the plurality of protrusions is disposed within a respective one of the plurality of channels.

16 Claims, 7 Drawing Sheets

(56) References Cited

U.S. PATENT DOCUMENTS

| | | | | |
|---|---|---|---|---|
| 6,036,037 | A | | 3/2000 | Scheffer et al. |
| D440,877 | S | | 4/2001 | Lichtman et al. |
| D447,956 | S | | 9/2001 | Bretz et al. |
| D450,581 | S | | 11/2001 | Lichtman et al. |
| D463,292 | S | | 9/2002 | Del Bianco |
| 6,564,959 | B2 | | 5/2003 | Saito et al. |
| D498,670 | S | | 11/2004 | Cummings et al. |
| D506,677 | S | | 6/2005 | Bretz et al. |
| D507,491 | S | | 7/2005 | Bretz et al. |
| D507,743 | S | | 7/2005 | Bretz et al. |
| D508,854 | S | | 8/2005 | Livingston |
| 6,932,230 | B2 | | 8/2005 | Pedmo et al. |
| D510,273 | S | | 10/2005 | Bretz et al. |
| 7,021,479 | B2 | | 4/2006 | Pedmo et al. |
| D523,347 | S | | 6/2006 | Livingston |
| D524,657 | S | | 7/2006 | Harris et al. |
| D528,012 | S | | 9/2006 | Snyder |
| D535,885 | S | | 1/2007 | Davis et al. |
| D565,417 | S | | 4/2008 | Lee et al. |
| D566,561 | S | | 4/2008 | Trost |
| D566,563 | S | | 4/2008 | Trost |
| 7,364,046 | B2 | | 4/2008 | Joshi et al. |
| D586,224 | S | | 2/2009 | Darr et al. |
| D626,851 | S | * | 11/2010 | El Aquah ..... D9/557 |
| D627,659 | S | | 11/2010 | El Aquah |
| D629,304 | S | | 12/2010 | El Aquah |
| D666,917 | S | | 9/2012 | El Aquah |
| D670,175 | S | | 11/2012 | Philip et al. |
| 8,439,214 | B2 | | 5/2013 | Darr et al. |
| 8,505,758 | B2 | | 8/2013 | Oshino |
| 8,556,098 | B2 | | 10/2013 | Peykoff et al. |
| 8,561,822 | B2 | | 10/2013 | Beck et al. |
| 8,925,750 | B2 | | 1/2015 | Darr et al. |
| 8,939,316 | B2 | | 1/2015 | Pasutanon et al. |
| 9,090,374 | B2 | | 7/2015 | Oshino |
| 9,120,589 | B2 | | 9/2015 | Hanan et al. |
| 9,132,933 | B2 | | 9/2015 | Hanan |
| D763,090 | S | * | 8/2016 | Zeng ..... D9/557 |
| D763,091 | S | | 8/2016 | Zeng et al. |
| 9,828,166 | B2 | | 11/2017 | Bouffand et al. |
| D818,369 | S | | 5/2018 | Jasso Gomez |
| 10,023,346 | B2 | | 7/2018 | Hanan et al. |
| D833,880 | S | | 11/2018 | Barel |
| 10,150,585 | B2 | | 12/2018 | Peykoff et al. |
| 10,202,217 | B2 | | 2/2019 | Hanan et al. |
| 10,358,252 | B2 | | 7/2019 | Hanan et al. |
| 10,392,150 | B2 | | 8/2019 | Forsthovel et al. |
| D871,221 | S | | 12/2019 | Waltemyer et al. |
| 10,654,609 | B2 | | 5/2020 | Hanan et al. |
| 10,807,759 | B2 | | 10/2020 | Hanan et al. |
| 10,981,690 | B2 | | 4/2021 | Peykoff et al. |
| 11,130,608 | B2 | | 9/2021 | Nakayama |
| D932,905 | S | * | 10/2021 | Klok ..... D9/557 |
| 11,136,159 | B2 | | 10/2021 | Waltemyer et al. |
| 11,220,368 | B2 | | 1/2022 | Hanan et al. |
| 2009/0184127 | A1 | | 7/2009 | Mooney |
| 2012/0228258 | A1 | * | 9/2012 | Heisner ..... B65D 1/40 215/384 |
| 2013/0026128 | A1 | | 1/2013 | Beck et al. |
| 2013/0153529 | A1 | | 6/2013 | Nakayama et al. |
| 2013/0213925 | A1 | | 8/2013 | Forsthovel et al. |
| 2013/0213926 | A1 | * | 8/2013 | Kurihara ..... B65D 79/0081 215/371 |
| 2015/0321826 | A1 | | 11/2015 | Bouffand et al. |
| 2019/0322404 | A1 | | 10/2019 | Forsthovel et al. |
| 2020/0255178 | A1 | | 8/2020 | Hanan et al. |
| 2021/0031965 | A1 | | 2/2021 | Hanan et al. |
| 2021/0061510 | A1 | | 3/2021 | Hanan et al. |
| 2021/0197999 | A1 | | 7/2021 | Peykoff et al. |
| 2024/0010384 | A1 | | 1/2024 | Parda et al. |

OTHER PUBLICATIONS

International Search Report and Written Opinion issued for PCT/US2023/027222 dated Dec. 4, 2023 (20 pages).

* cited by examiner

CONTAINER HAVING GUSSETS

BACKGROUND

Containers, such as single use plastic water bottles, can be manufactured (e.g., via a blow molding process) in such a way so as to limit the amount of plastic used. However, as the amount of plastic decreases, the thickness of the features of the containers (e.g., sidewalls, base, etc.) reduces. As the thickness continues to be decreased, the containers begin to exhibit poor performance specifications (e.g., significant elongation when pressurized, bending, deformation, etc.), which can prevent the containers from properly fitting along manufacturing lines, in traditional sized packaging (e.g., boxes, etc.), and/or within vending machines, as well as impact the end user's experience (e.g., the container crumpling too easily, the container being difficult to firmly grasp, etc.).

SUMMARY

One embodiment relates to a container. The container includes a base and a body positioned above the base. The base includes a plurality of feet with a plurality of recesses positioned between the plurality of feet. The neck portion defines an outlet. The body includes a plurality of ribs, a plurality of channels, and a plurality of support columns. The plurality of ribs extend around a periphery of the body and along at least a portion of a height of the body. The plurality of channels extend around the periphery and are positioned between the plurality of ribs. The plurality of support columns are spaced about the periphery and extend along at least a portion of the height of the body. Each of the plurality of support columns includes a plurality of protrusions that are vertically aligned. Each of the plurality of protrusions is disposed within a respective one of the plurality of channels.

Another embodiment relates to a container. The container includes a base, a neck portion, and a body positioned between the base and the neck portion. The body includes an upper body portion, a lower body portion, a support column, and a final protrusion. The upper body portion includes a first plurality of ribs and a first plurality of channel. The first plurality of ribs extend around a first periphery of the upper body portion and along at least a portion of a first height of the upper body portion. The first plurality of channels extend around the first periphery and are positioned between the first plurality of ribs. The lower body portion includes a second plurality of ribs and a second plurality of channels. The second plurality of ribs extend around a second periphery of the lower body portion and along at least a portion of a second height of the lower body portion. The first plurality of ribs are different than the second plurality of ribs. The second plurality of channels extend around the second periphery and are positioned between the second plurality of ribs. The second plurality of channels include a lowermost channel positioned between the lower body portion and the base. The support column includes a first plurality of protrusions and a second plurality of protrusions that are vertically aligned. The first plurality of protrusions have a first size. The second plurality of protrusions have a second size that is different than the first size. Each of the first plurality of protrusions and the second plurality of protrusions is disposed within a respective one of the first plurality of channels or the second plurality of channels. The first plurality of protrusions and the second plurality of protrusions alternate along the upper body portion and the lower body portion. The final protrusion is disposed within the lowermost channel. The final protrusion is offset from the support column.

Still another embodiment relates to a single use plastic water bottle. The single use plastic water bottle includes a base, an outlet, and a body positioned between the base and the outlet. The body includes a plurality of channels, a plurality of ribs, and a plurality of support columns. The plurality of channels extend around a periphery of the body and along at least a portion of a height of the body. The plurality of ribs extend around the periphery and are positioned between the plurality of channels. The plurality of support columns are spaced about the periphery. Each of the plurality of support columns includes a first plurality of protrusions having a first size and a second plurality of protrusions having a second size different than the first size. The first plurality of protrusions and the second plurality of protrusions are vertically aligned. Each of the first plurality of protrusions and the second plurality of protrusions is disposed within a respective one of the plurality of channels. The first plurality of protrusions and the second plurality of protrusions alternate along the height of the body.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
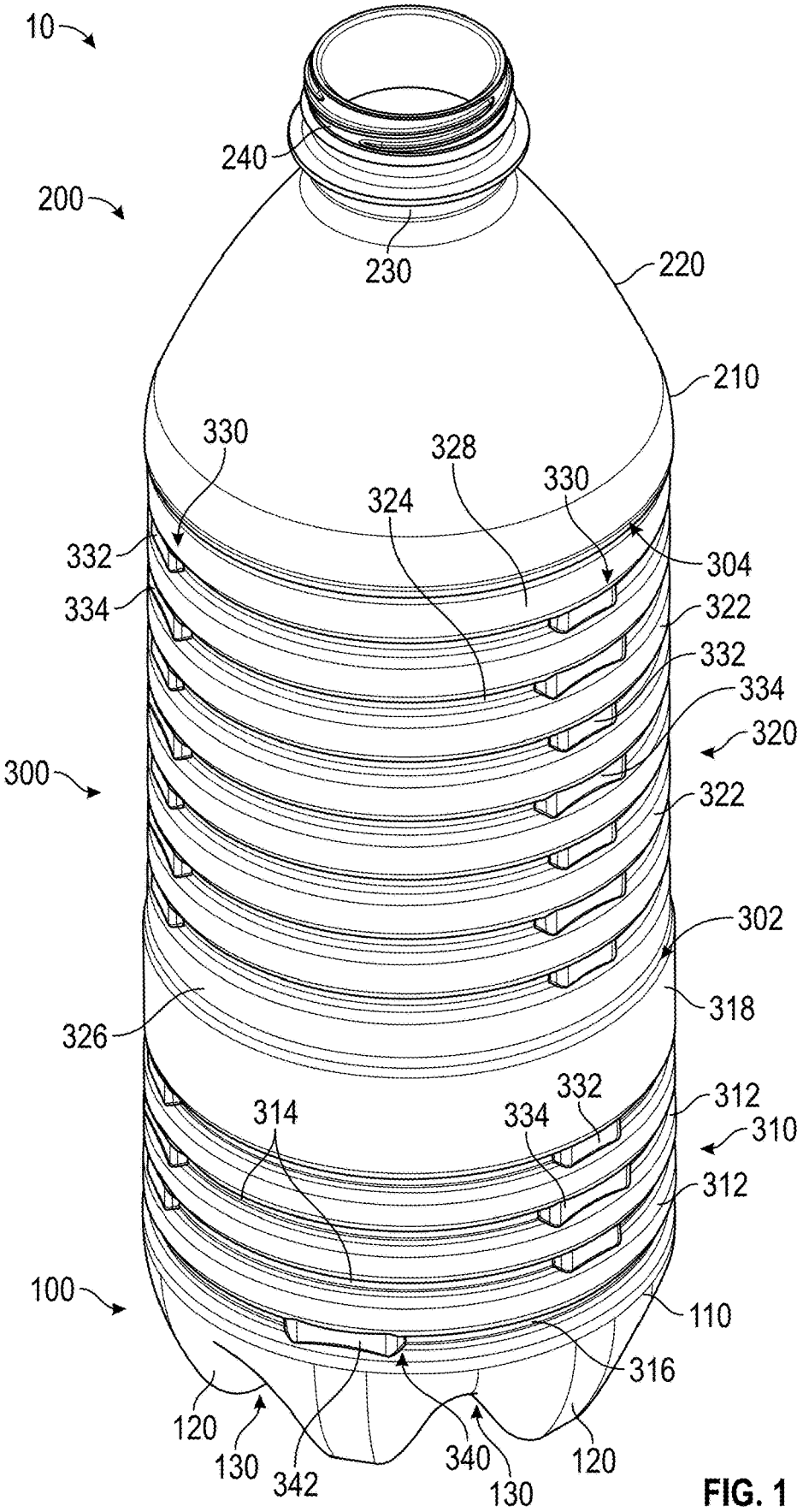
FIG. 1 is a perspective view of a container, according to an exemplary embodiment.
Figure 2:
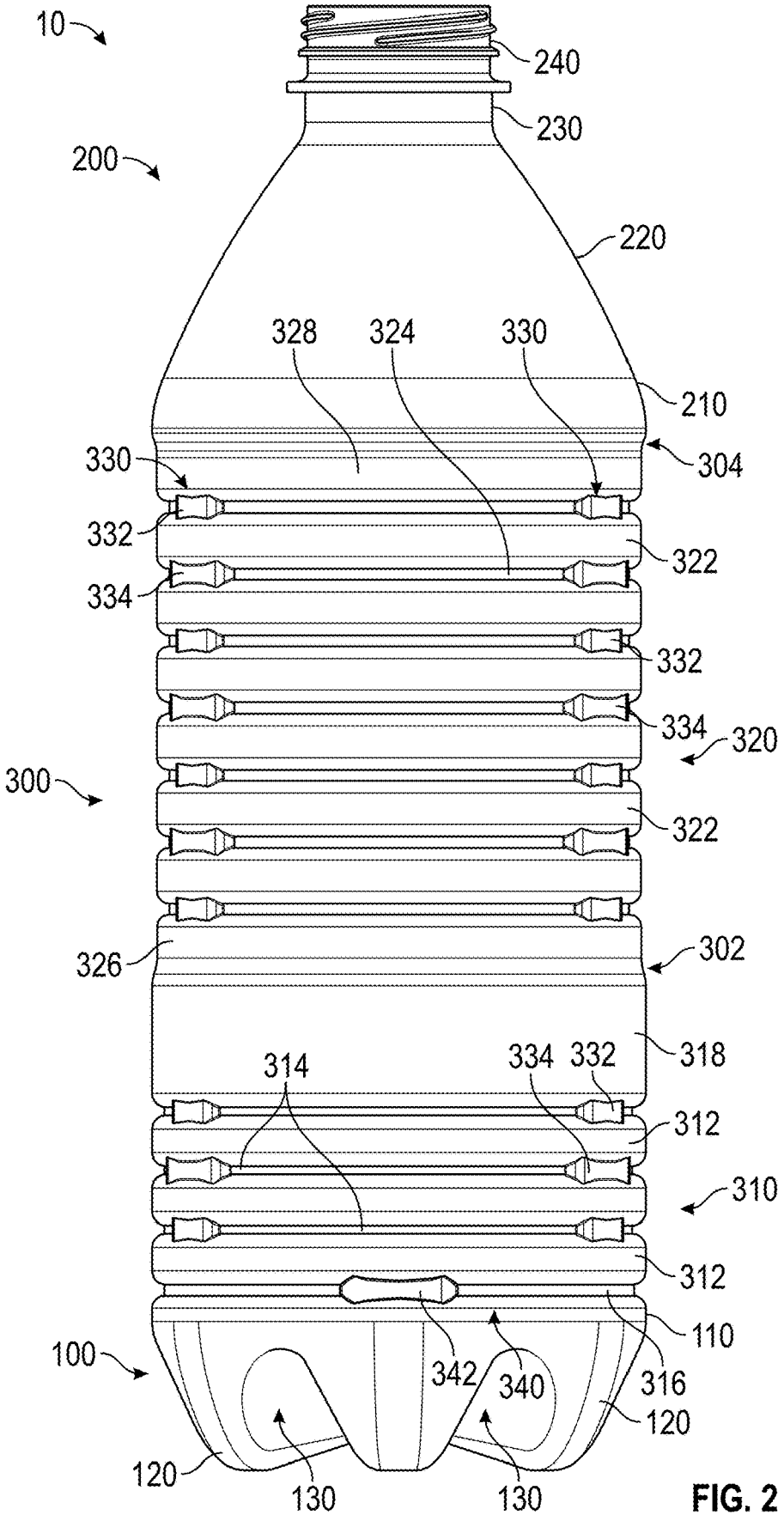
FIG. 2 is a front view of the container of FIG. 1, according to an exemplary embodiment.
Figure 3:
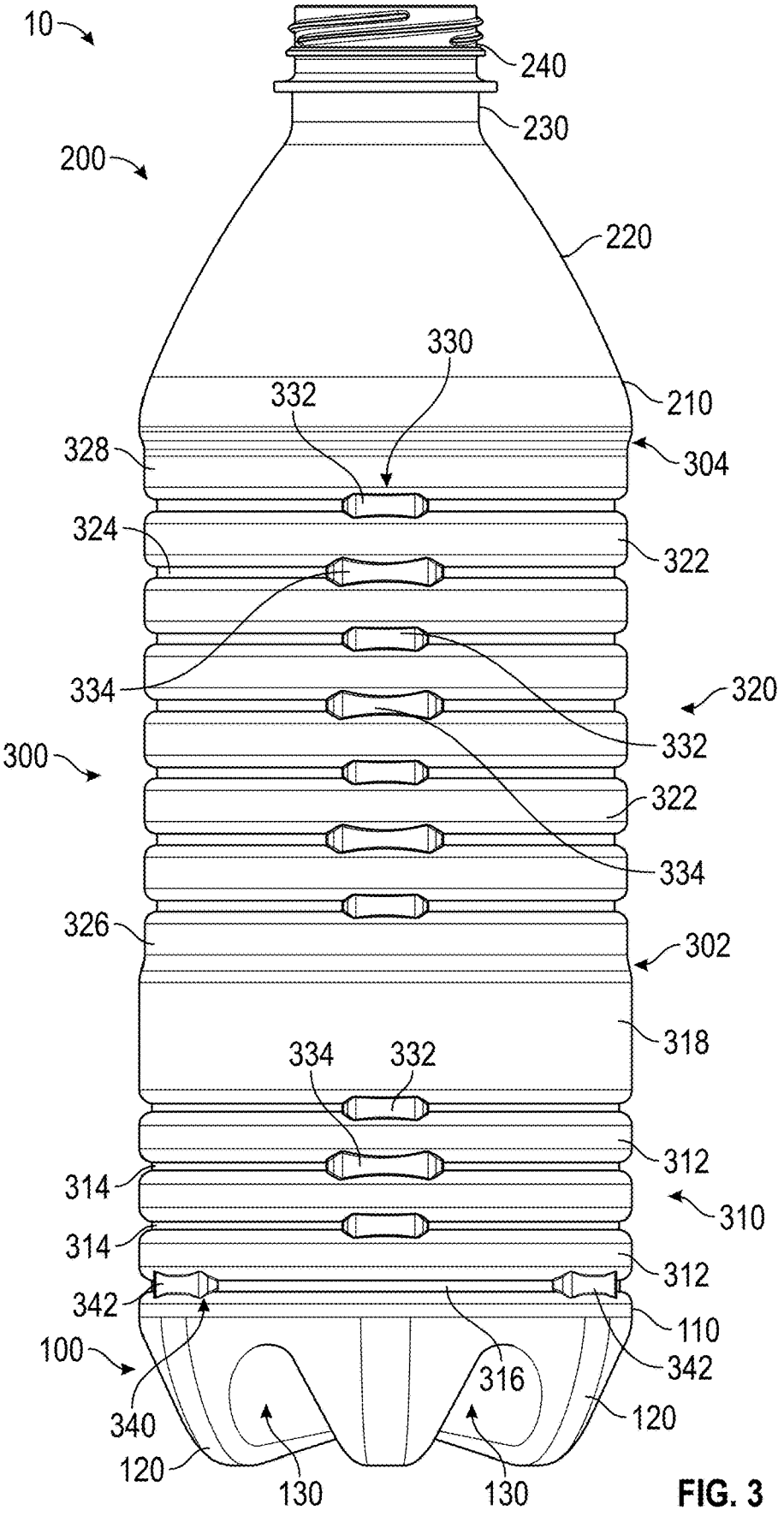
FIG. 3 is a rear view of the container of FIG. 1, according to an exemplary embodiment.
Figure 4:
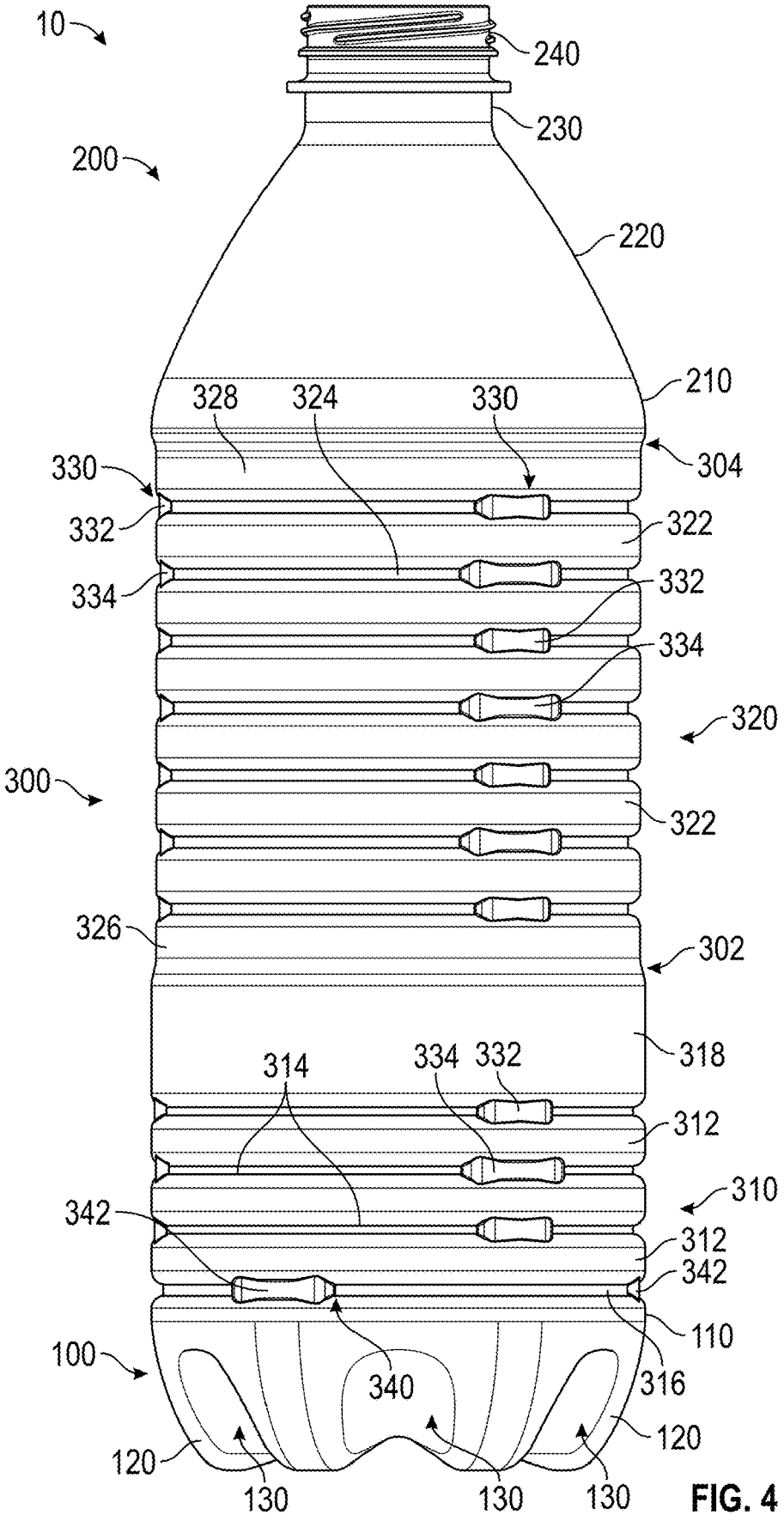
FIG. 4 is a right side view of the container of FIG. 1, according to an exemplary embodiment.
Figure 5:
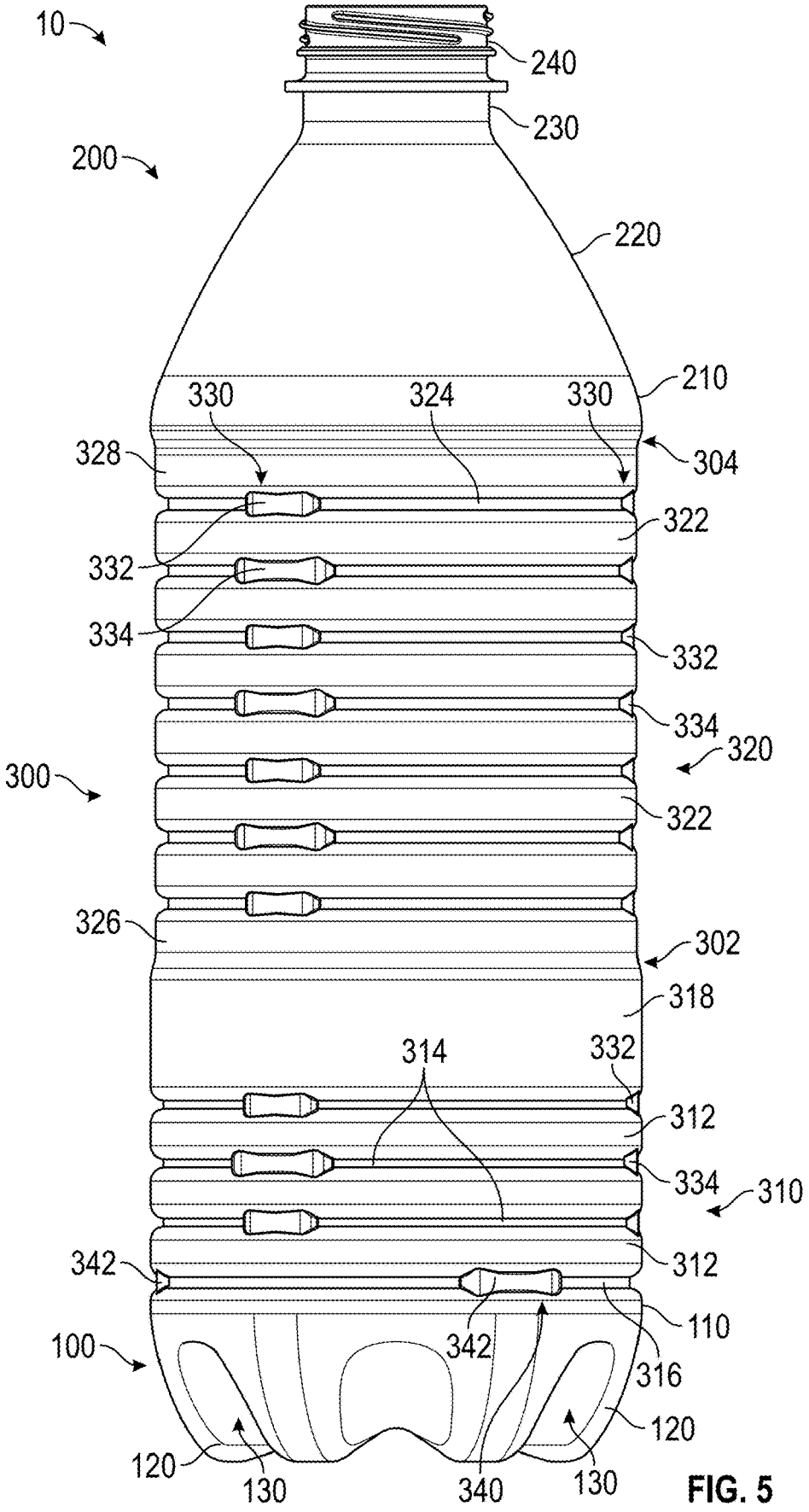
FIG. 5 is a left side view of the container of FIG. 1, according to an exemplary embodiment.
Figure 6:
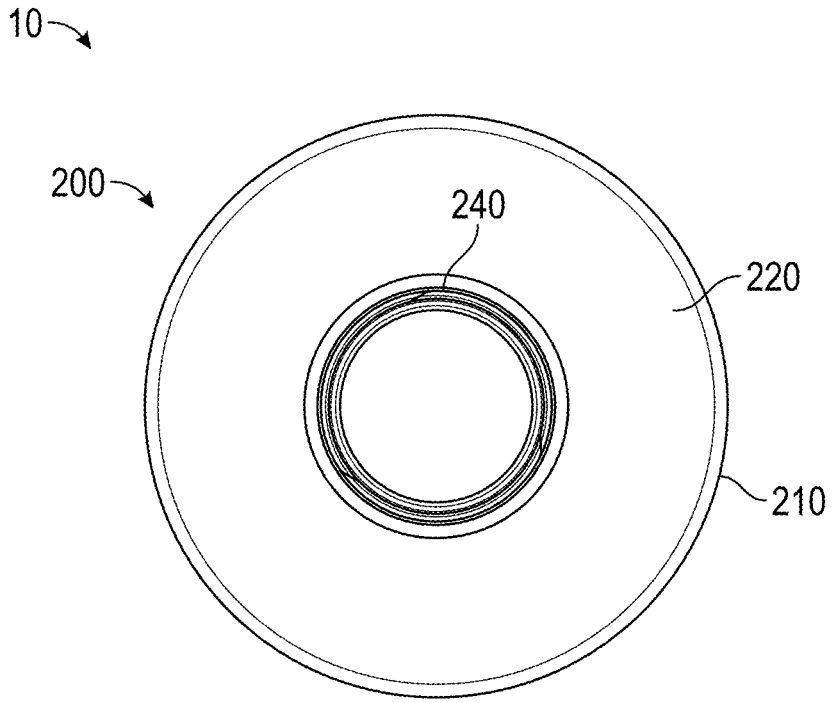
FIG. 6 is a top view of the container of FIG. 1, according to an exemplary embodiment.
Figure 7:
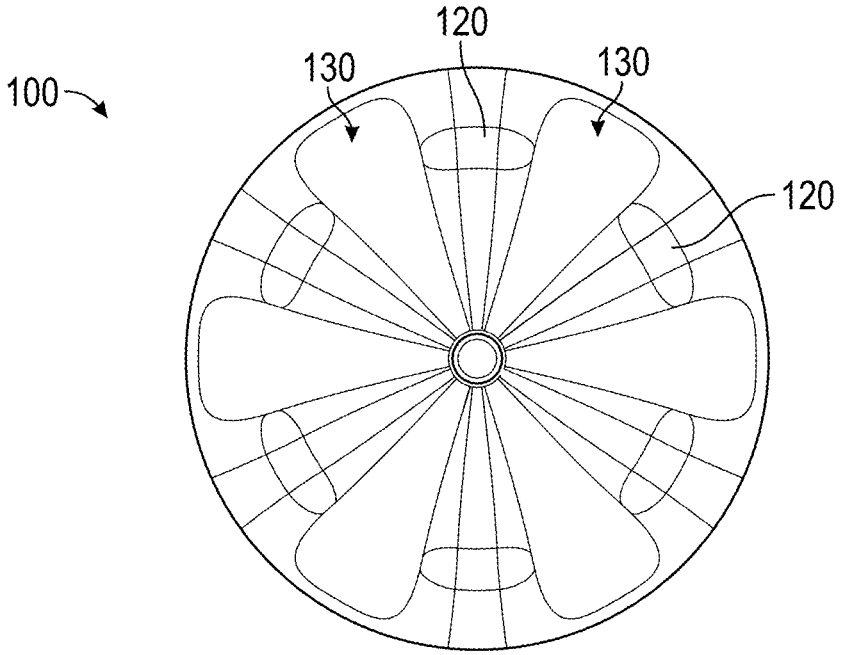
FIG. 7 is a bottom view of the container of FIG. 1, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

According to an exemplary embodiment, a container (e.g., a vessel, a receptacle, a bottle, a single use plastic water bottle, etc.) of the present disclosure includes a plurality of first gussets arranged in a plurality of columns spaced about the periphery of the container. The plurality of columns extend along at least a portion of a length of the container. The container also includes a plurality of second gussets positioned below the plurality of columns. The plurality of second gussets are spaced about the periphery in a ring arrangement. Each of the plurality of second gussets is offset from and positioned between adjacent columns of the plurality of columns. The various gussets and their positioning may provide enhanced structural rigidity and prevent bending, leaning, or stretching/elongation of the container.

According to the exemplary embodiment shown in FIGS. 1-8, a receptacle or vessel, shown as container 10, is configured as a bottle. In some embodiments, the container 10 is a plastic bottle. In some embodiments, the container 10 is recyclable. In some embodiments, the container 10 is biodegradable or compostable. In some embodiments, the container 10 is a single use container. In some embodiments, the container 10 is a reusable container. In some embodiments, the container 10 is configured to receive and hold beverage contents (e.g., water, juice, sport drink, soda, etc.). In some embodiments, the container 10 is configured to receive and hold another liquid (e.g., cleaning fluids, etc.). In some embodiments, the container 10 is configured to receive and hold non-liquid contents (e.g., gaseous contents, solid contents, etc.).

As shown in FIGS. 1-7, the container 10 includes (i) a first portion or lower portion, shown as base 100, (ii) a second portion or upper portion, shown as neck portion 200, and (iii) a third portion or middle portion, shown as body 300. As shown in FIGS. 1-5 and 7, the base 100 includes an upper edge, shown as base rim 110, and a plurality of feet, shown as feet 120, extending downward from the base rim 110 and evenly spaced about the periphery of the base 100 with a plurality of recesses, shown as foot valleys 130, positioned between the feet 120. According to the exemplary embodiment shown, the base 100 includes six feet 120. In other embodiments, the base 100 includes a different number of the feet 120. By way of example, the base 100 may include a different, even number of feet (e.g., four, eight, etc.). By way of another example, the base 100 may include a different, odd number of the feet 120 (e.g., three, five, seven, nine, etc.).

As shown in FIGS. 1-6, the neck portion 200 includes (i) a lower edge, shown as shoulder 210, (ii) a tapering portion, shown as bell 220, extending upward from the shoulder 210 and tapering inward, (iii) a narrow passage, shown as neck 230, extending upward from the bell 220, and (iv) a screw end, shown as finish 240, extending upward from the neck 230. According to an exemplary embodiment, the finish 240 defines an outlet through which contents of the container 10 (e.g., a beverage, a liquid, etc.) can be poured. In some embodiments, the finish 240 defines threads to facilitate screwing a cap or lid thereto to close the container 10. In some embodiments, the finish 240 defines a lip to which a cap or lid can be secured and popped off of.

As shown in FIGS. 1-5, the body 300 includes (i) a first sub-portion, shown as lower body portion 310, (ii) a second sub-portion, shown as upper body portion 320, (iii) a first transition or intermediate portion, shown as lower taper 302, connecting the lower body portion 310 and the upper body portion 320 together, and (iv) a second transition, shown as upper taper 304, connecting the upper body portion 320 to the shoulder 210 of the neck portion 200. The lower body portion 310 extends upward from the base rim 110 of the base 100 to the lower taper 302. The upper body portion 320 extends upward from the lower taper 302 to the upper taper 304. According to an exemplary embodiment, the lower body portion 310 and/or the upper body portion 320 are configured to function as a grip for the container 10 and/or support a label thereon.

According to an exemplary embodiment, the lower taper 302 transitions the body 300 from a first outermost diameter of the lower body portion 310 to a different, second outermost diameter of the upper body portion 320. In some embodiments, the first outermost diameter is greater than the second outermost diameter. In some embodiments, the first outermost diameter is less than the second outermost diameter. In some embodiments, the body 300 does not include the lower taper 302 such that (i) the lower body portion 310 and the upper body portion 320 are in direct engagement and (ii) the body 300 has a uniform diameter across the lower body portion 310 and the upper body portion 320.

According to an exemplary embodiment, the upper taper 304 transitions the container from the second outermost diameter of the upper body portion 320 to a larger, third outermost diameter of the shoulder 210 of the neck portion 200. In some embodiments, the third outermost diameter of the shoulder 210 is less than, or the same or substantially the same as, the first outermost diameter of the lower body portion 310. In some embodiments, the third outermost diameter of the shoulder 210 is the less than, or the same or substantially the same as, a fourth outermost diameter of the base rim 110 of the base 100. In some embodiments, the body 300 does not include the upper taper 304 such that (i) the upper body portion 320 and the shoulder 210 are in direct engagement and (ii) the container 10 has a uniform diameter across the upper body portion 320 and the shoulder 210.

According to an exemplary embodiment, the container 10 has the following dimensional specifications: (a) the container 10 has a volume capacity of about 500 ml (e.g., 502.2 ml at fill point, 521.4 ml at brimful, etc.), (b) the container 10 has an overall height of about 196.45 mm, (c) the first outermost diameter of the lower body portion 310 is about 66.12 mm, (d) a first height of the lower body portion 310 (i.e., from the base rim 110 to the lower edge of upper body portion 320 (including the lower taper 302)) is about 47.72 mm, (e) the second outermost diameter of the upper body portion 320 is about 64.9 mm, (f) a second height of the upper body portion 320 (i.e., from the upper edge of the lower taper 302 to the lower edge of the upper taper 304) is about 69 mm, (g) the third outermost diameter of the shoulder 210 is about 65.92 mm, (h) a third height of the neck portion 200 (i.e., from the lower edge of the upper taper 304 to the upper rim of the finish 240) is about 59.73 mm, (i) the fourth outermost diameter of the base rim 110 is about 66.12 mm, and (j) a fourth height of the base 100 is about 20 mm. In other embodiments, the container 10 has different dimensions (e.g., has a different volume capacity, has a different overall height, has different diameters, etc.).

As shown in FIGS. 1-5, the lower body portion 310 includes a first plurality of protrusions, shown as lower ribs 312, spaced along and extending around the periphery of the lower body portion 310 with a first plurality of peripheral recesses, shown as lower channels 314, defined along the lower body portion 310 and between the lower ribs 312. According to the exemplary embodiment shown, the lower body portion 310 includes three lower ribs 312 and three lower channels 314. In other embodiments, the lower body portion 310 includes a different number of the lower ribs 312 and the lower channels 314 (e.g., one, two, four, five, etc.). As shown in FIGS. 1-5, the lower body portion 310 defines a lowermost channel, shown as final channel 316, positioned between the base rim 110 and a lowermost one of the lower ribs 312. In some embodiments, the lower channels 314 and the final channel 316 have the same or substantially the same dimensions (e.g., depth, height, etc.). In some embodiments, the lower channels 314 and the final channel 316 have different dimensions (e.g., the final channel 316 has a larger height than the lower channels 314, the final channel 316 has a shallower depth than the lower channels 314, the final channel 316 has a deeper depth than the lower channels 314, etc.). As shown in FIGS. 1-5, the lower portion 310 includes an upper feature, shown as cylindrical face 318, positioned between the lower taper 302 and the uppermost lower channel 314. In some embodiments, the cylindrical face 318 defines one or more vertical recesses, one or more vertical channels, one or more vertical ribs, one or more peripheral ribs (e.g., similar to the lower ribs 312), one or more peripheral channels (e.g., similar to the lower channels 314), and/or still other features. In some embodiments, the lower body portion 310 does not include the cylindrical face 318.

As shown in FIGS. 1-5, the upper body portion 320 includes a second plurality of protrusions, shown as upper ribs 322, spaced along and extending around the periphery of the upper body portion 320 with a second plurality of peripheral recesses, shown as upper channels 324, defined along the upper body portion 320 and between the upper ribs 322. According to the exemplary embodiment shown, the upper body portion 320 includes six upper ribs 322 and seven upper channels 324. In other embodiments, the upper body portion 320 includes a different number of the upper ribs 322 (e.g., one, two, three, four, five, seven, eight, etc.) and a different number of the upper channels 324 (e.g., two, three, four, five, six, eight, nine, etc.). As shown in FIGS. 1-5, the upper body portion 320 includes (i) a lower feature, shown as lower cylindrical face 326, positioned between the lower taper 302 and the lowermost upper channel 324 and (ii) an upper feature, shown as upper cylindrical face 328, positioned between the uppermost upper channel 324 and the upper taper 304.

According to an exemplary embodiment, the lower ribs 312 have the first outermost diameter of the lower body portion 310 and the upper ribs 322 have the second outermost diameter of the upper body portion 320 such that the lower ribs 312 and the upper ribs 322 have different diameters. In other embodiments, the lower ribs 312 and/or the upper ribs 322 have a different diameter than the lower body portion 310 and/or the upper body portion 320, respectively (e.g., the lower ribs 312 are slightly recessed relative to the cylindrical face 318 of the lower body portion 310, the lower ribs 312 protrude outward further than the cylindrical face 318 of the lower body portion 310, the upper ribs 322 are slightly recessed relative to the lower cylindrical face 326 and the upper cylindrical face 328 of the upper body portion 320, the upper ribs 322 protrude outward further than the lower cylindrical face 326 and the upper cylindrical face 328 of the upper body portion 320, etc.). Therefore, the lower ribs 312 and the upper ribs 322 may have the same diameters or still different diameters.

According to an exemplary embodiment, each of the lower ribs 312 have a first height and each of the upper ribs 322 have a second height that is different than the first height. Specifically, as shown in FIGS. 1-5, the first height of each of the lower ribs 312 is less than the second height of each of the upper ribs 322. In other embodiments, the first height of each of the lower ribs 312 is greater than the second height of each of the upper ribs 322. In still other embodiments, the first height of each of the lower ribs 312 is the same or substantially the same as the second height of each of the upper ribs 322.

As shown in FIGS. 1-5, the body 300 includes a plurality of support columns, shown as gusset columns 330, spaced about the periphery of the body 300 and extending along at least a portion of the height of the body 300 (e.g., a majority of the height, not along the portion with the cylindrical face 318, etc.). Each respective gusset column 330 of the plurality of gusset columns 330 includes a first plurality of protrusions (e.g., tabs, braces, supports, struts, reinforcements, etc.), shown small gussets 332, and a second plurality of protrusions (e.g., tabs, braces, supports, struts, reinforcements, etc.), shown as large gussets 334, vertically aligned with each other to form or define each respective gusset column 330. More specifically, the small gussets 332 and the large gussets 334 of a respective gusset column 330 alternate along the height of the body 300 (e.g., small, large, small, large, etc.; large, small, large, small, etc.) with each of the small gussets 332 and each of the large gussets 334 being disposed or positioned within a respective one of the lower channels 314 of the lower body portion 310 or the upper channels 324 of the upper body portion 320. The small gussets 332 have a first width and the large gussets 334 have a second width that is greater or larger than the small gussets 332. By way of example, the first width of the small gussets 332 may be less than or equal to 90% of the second width of the large gussets 334. By way of another example, the first width of the small gussets 332 may be less than or equal to 80% of the second width of the large gussets 334. By way of still another example, the first width of the small gussets 332 may be less than or equal to 75% of the second width of the large gussets 334. By way of yet another example, the first width of the small gussets 332 may be less than or equal to 60% of the second width of the large gussets 334. By way of still yet another example, the first width of the small gussets 332 may be less than or equal to 50% of the second width of the large gussets 334.

As shown in FIGS. 1-5, (i) each of the gusset columns 330 aligns with a center (e.g., a central axis) of a respective one of the feet 120 and (ii) the gusset columns 330 alternate between the feet 120 such that adjacent feet 120 do not include adjacent gusset columns 330. Rather, each of the feet 120 that does not have a corresponding gusset column 330 associated therewith including a single gusset, shown as bottom gusset 342 (e.g., last, offset, tertiary, isolated, etc.), centrally aligned therewith and positioned thereabove. More specifically, the body 300 includes a support ring, shown as gusset ring 340, includes a third plurality of protrusions (e.g., tabs, braces, supports, etc.), shown as bottom gussets 342 (e.g., last, offset, tertiary, isolated, etc.), spaced about the periphery of the body 300 and disposed or positioned in and along the final channel 316. The gusset ring 340 is rotationally offset from the gusset columns 330 with the bottom gussets 342 positioned between adjacent pairs of the gusset columns 330 such that an alternating pattern is provided where a first one of the gusset columns 330 is aligned with a first foot 120, a first one of the bottom gussets 342 is aligned with a second foot 120, a second one of the gusset columns 330 is aligned with a third foot 120, a second one of the bottom gussets 342 is aligned with a fourth foot 120, and so on. According to the exemplary embodiment shown in FIGS. 1-5, the bottom gussets 342 are the same or substantially the same as the large gussets 334. In other embodiments, the bottom gussets 342 are the same or substantially the same as the small gussets 332. In still other embodiments, the bottom gussets 342 are different than the small gussets 332 and the large gussets 334 (e.g., smaller than the small gussets 332, larger than the large gussets 334, a size between the small gussets 332 and the large gussets 334, etc.).

In some embodiments, the arrangement of the gusset columns 330, the small gussets 332, the large gussets 334, the gusset ring 340, and/or the bottom gussets 342 varies. In some embodiments, the gusset columns 330 do not include the small gussets 332. By way of example, the small gussets 332 may be replaced with the large gussets 334. By way of another example, the small gussets 332 are not replaced with the large gussets 334 such that spaces or gaps may be positioned between the large gussets 334. In some embodiments, the gusset columns 330 do not include the large gussets 334. By way of example, the large gussets 334 may be replaced with the small gussets 332. By way of another example, the large gussets 334 are not replaced with the small gussets 332 such that spaces or gaps may be positioned between the small gussets 332. In some embodiments, a first one of the gusset columns 330 includes all small gussets 332 and a second one of the gusset columns 330 includes all large gussets 334. In some embodiments, the body 300 does not include the gusset ring 340 such that the final channel 316 is empty or does not include gussets. In some embodiments, the bottom gussets 342 of the gusset ring 340 are aligned with the gusset columns 330 (i.e., no offset between the gusset ring 340 and the gusset columns 330). In some embodiments, the gusset columns 330 and/or the bottom gussets 342 are aligned with the foot valleys 130, rather than the feet 120. In some embodiments, (i) the body 300 includes additional gusset columns 330 such that the gusset columns 330 align with all of the feet 120, all of the foot valleys 130, or both and/or (ii) the gusset ring 340 includes additional bottom gussets 342 such that the bottom gussets 342 align with all of the feet 120, all of the foot valleys 130, or both. By way of example, the gusset columns 330 may align with all of the feet 120 and the bottom gussets 342 may align with all of the foot valleys 130. By way another of example, the gusset columns 330 may align with all of the foot valleys 130 and the bottom gussets 342 may align with all of the feet 120. In some embodiments, the body 300 includes a plurality of the gusset rings 340. By way of example, the body 300 may include a second gusset ring 340 positioned in the lowermost upper channel 324 of the upper body portion 320. By way of another example, a respective gusset ring 340 may be positioned at a repeating interval (e.g., small gusset 332, large gusset 334, and gusset ring 340 repeating along the height of the body 300, etc.).

Figure 8:
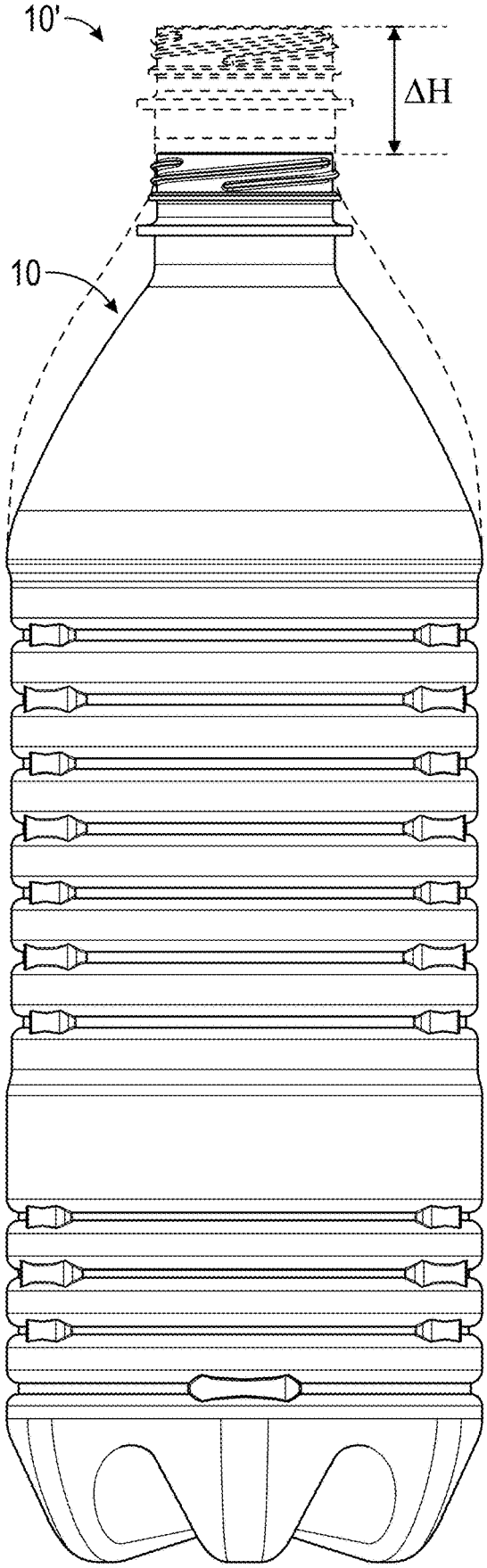
FIG. 8 is another front view of the container of FIG. 1 showing elongation of the container when pressurized relative to a base container, according to an exemplary embodiment.

According to an exemplary embodiment, the configuration (e.g., arrangement, positioning, size, shape, etc.) of the gusset columns 330, the small gussets 332, the large gussets 334, the gusset ring 340, and the bottom gussets 342 provides enhanced structural rigidity to the container 10 (e.g., which prevents bending, leaning, stretching/elongation, crumpling, etc. of the container 10 during manufacturing and/or use) relative to a similar container, shown as base container 10', that does not include such features. Specifically, as shown in FIG. 8, after being manufactured (e.g., blow molded) and then being pressurized (e.g., with nitrogen), the container provides enhanced elongation performance characteristics relative to the base container 10'. Specifically, the base container 10' has a significantly greater amount of elongation, shown as height expansion ΔH, than the container 10 when pressurized. According to an exemplary embodiment, the height expansion ΔH of the container 10 when pressurized at 0.75 bar or less above atmospheric pressure for one hour while at a temperature of 22° C. is less than or equal to (i.e., at most) 3.5% of the overall height of the container 10 (e.g., an overall height of about 196.45 mm and about 6.875 mm of height expansion, etc.).

Applicant performed various tests on the container 10 and the base container 10' to quantify the performance characteristics of the container 10 relative to the base container 10' (which does not include the gusset columns 330 and the gusset ring 340). The base container 10', after being pressurized at 0.75 bar above atmospheric pressure for one hour while at a temperature of 22° C., exhibited, on average, greater than an 8% expansion of the overall height thereof. Such significant elongation can prevent the base container 10' from properly fitting along manufacturing lines, in traditional sized packaging (e.g., boxes, etc.), and/or within vending machines. Advantageously, the container 10 exhibited significantly less height expansion AH during testing. Specifically, the container 10, after being pressurized at 0.75 bar above atmospheric pressure for one hour while at a temperature of 22° C., exhibited, on average, a 3.16% expansion of the overall height thereof. Also, the container 10, after being pressurized at 0.50 bar above atmospheric pressure for one hour while at a temperature of 22° C., exhibited, on average, a 2.66% expansion of the overall height thereof.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Language such as the phrases "at least one of X, Y, and Z" and "at least one of X, Y, or Z," unless specifically stated otherwise, are understood to convey that an element may be either X; Y; Z; X and Y; X and Z; Y and Z; or X, Y, and Z (i.e., any combination of X, Y, and Z). Thus, such language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the container 10 as shown in the various exemplary embodiments is illustrative only. Additionally, any element disclosed in one embodiment may be incorporated or utilized with any other embodiment disclosed herein.

The invention claimed is:

1. A container comprising:

a base including a plurality of feet with a plurality of recesses positioned between the plurality of feet;

a neck portion defining an outlet; and a body positioned between the base and the neck portion, the body including:

an upper portion;

a lower portion;

an intermediate portion positioned between the upper portion and the lower portion;

a plurality of ribs extending around a periphery of the body and along at least a portion of a height of the upper portion and the lower portion the body;

a plurality of channels extending around the periphery and positioned between the plurality of ribs; and a plurality of support columns spaced about the periphery and extending along at least a portion of the height of the body, each of the plurality of support columns including a plurality of protrusions that are vertically aligned, each of the plurality of protrusions is disposed within a respective one of the plurality of channels, wherein the plurality of protrusions include a first plurality of protrusions having a first size and a second plurality of protrusions having a second size different than the first size, and wherein the first plurality of protrusions and the second plurality of protrusions alternate along the portion of the height of the body;

wherein none of the plurality of ribs, the plurality of channels, and the plurality of protrusions are positioned along the intermediate portion.

2. The container of claim 1, wherein the plurality of protrusions are a plurality of support column protrusions, wherein the body includes a support ring positioned below the plurality of support columns, wherein the support ring includes a plurality of support ring protrusions spaced about the periphery and disposed within a lowermost one of the plurality of channels, and wherein the plurality of support ring protrusions are offset from the plurality of support columns such that each of the plurality of support ring protrusions is positioned between an adjacent pair of the plurality of support columns.

3. The container of claim 2, wherein the plurality of support ring protrusions have a fixed size.

4. The container of claim 2, wherein the plurality of support ring protrusions have the first size or the second size.

5. The container of claim 2, wherein a first one of the plurality of support column protrusions aligns with a first one of the plurality of feet and a first one of the plurality of support ring protrusions aligns with a second one of the plurality of feet.

6. The container of claim 2, wherein a first one of the plurality of support column protrusions aligns with a first one of the plurality of recesses and a first one of the plurality of support ring protrusions aligns with a second one of the plurality of recesses.

7. The container of claim 1, wherein at least one of the plurality of support columns aligns with a respective one of the plurality of feet.

8. The container of claim 7, wherein the body includes a greater number of the plurality of feet than the plurality of support columns.

9. The container of claim 1, wherein the plurality of ribs include a plurality of upper ribs defined along the upper portion and a plurality of lower ribs defined along the lower portion.

10. The container of claim 9, wherein the plurality of upper ribs are different than the plurality of lower ribs, and wherein each of the plurality of upper ribs have a different height than each of the plurality of lower ribs.

11. The container of claim 9, wherein the plurality of upper ribs are different than the plurality of lower ribs, and wherein each of the plurality of upper ribs have a different diameter than each of the plurality of lower ribs.

12. The container of claim 9, wherein the container has a first outermost diameter along the lower portion, a second outermost diameter along the upper portion, a third outermost diameter along the neck portion, and a fourth outermost diameter along the base, wherein the second outermost diameter is less than the first outermost diameter, the third outermost diameter, and the fourth outermost diameter, and wherein the third outermost diameter is less than or equal to the first outermost diameter and the fourth outermost diameter.

13. The container of claim 12, wherein the first outermost diameter and the fourth outermost diameter are the same.

14. A container comprising:

a base; and a body positioned above the base, the body including:

an upper body portion including:

a first plurality of ribs extending around a first periphery of the upper body portion and along at least a portion of a first height of the upper body portion; and a first plurality of channels extending around the first periphery and positioned between the first plurality of ribs;

a lower body portion having a different diameter than the upper body portion, the lower body portion including:

a second plurality of ribs extending around a second periphery of the lower body portion and along at least a portion of a second height of the lower body portion, wherein each of the first plurality of ribs have a same, first rib height, wherein each of the second plurality of ribs have a same, second rib height, and wherein the first rib height is different than the second rib height; and a second plurality of channels extending around the second periphery and positioned between the second plurality of ribs, the second plurality of channels including a lowermost channel positioned between the lower body portion and the base;

a support column including a first plurality of protrusions and a second plurality of protrusions that are vertically aligned, the first plurality of protrusions having a first size, the second plurality of protrusions having a second size that is different than the first size, each of the first plurality of protrusions and the second plurality of protrusions disposed within a respective one of the first plurality of channels or the second plurality of channels, and the first plurality of protrusions and the second plurality of protrusions alternating along the upper body portion and the lower body portion; and a final protrusion disposed within the lowermost channel, the final protrusion offset from the support column and has no other protrusions vertically aligned therewith along the upper body portion and the lower body portion.

15. The container of claim 14, wherein the base includes a plurality of feet with a plurality of recesses positioned between the plurality of feet, wherein the support column aligns with a first one of the plurality of feet, wherein the final protrusion aligns with a second one of the plurality of feet positioned adjacent the first one of the plurality of feet, and wherein the first protrusions, the second protrusions, and the final protrusion do not align with any of the plurality of recesses.

16. A single use plastic water bottle comprising:

a base;

an outlet; and a body positioned between the base and the outlet, the body including:

a plurality of channels extending around a periphery of the body and along at least a portion of a height of the body;

a plurality of ribs extending around the periphery and positioned between the plurality of channels; and a plurality of support columns spaced about the periphery, each of the plurality of support columns including a first plurality of protrusions having a first size and a second plurality of protrusions having a second size different than the first size, the first plurality of protrusions and the second plurality of protrusions vertically aligned, each of the first plurality of protrusions and the second plurality of protrusions disposed within a respective one of the plurality of channels, the first plurality of protrusions and the second plurality of protrusions alternating along the height of the body;

wherein an arrangement of the plurality of support columns, the first plurality of protrusions, and the second plurality of protrusions facilitate providing a height expansion of the single user plastic water bottle that is less than or equal to 3.5% of an overall height thereof when pressurized at 0.75 bar above atmospheric pressure for one hour while at a temperature of 22° C.

* * * * *